United States Patent [19]

Dery

[11] Patent Number: 4,678,190

[45] Date of Patent: Jul. 7, 1987

[54] SET OF DICES FOR LOTTERY

[76] Inventor: Yves Dery, 4500 Samson Boulevard - unité 4, Chomedey, Laval, Quebec, Canada, H7W 2H1

[21] Appl. No.: 840,682

[22] Filed: Mar. 18, 1986

[51] Int. Cl.[4] ..... A63F 9/04

[52] U.S. Cl. ..... 273/146

[58] Field of Search ..... 273/146

[56] References Cited

U.S. PATENT DOCUMENTS 4,497,487 2/1985 Crippen ..... 273/146

FOREIGN PATENT DOCUMENTS 1059816 6/1959 Fed. Rep. of Germany ..... 273/146
2511838 9/1975 Fed. Rep. of Germany ..... 273/146
2474878 8/1981 France ..... 273/146
588254 5/1977 Switzerland ..... 373/146

*Primary Examiner*—Paul E. Shapiro

[57] ABSTRACT

There disclosed a set of cubic dices to be thrown on a surface for aiding a lottery player in the selection of hopefully winning numbers. The dices are suited for a lottery of the type in which a player selects a predetermined number of integers in a given series of such integers. The numbers of dices in the set is equal to the number of integers to be selected in the specific lottery type. At least some of the six faces of each dice bears at least two distinct integers facing in opposite directions and forming two series of lottery integer. The dice integers are distributed on the various dice faces such that each integer will appear on two dices and such all the integers on any given dice will not appear on any other single dice but will be distributed amongst the remaining dices of the set. The dices are successively thrown and each time the player has to pick the integer facing him. After each throw, the player has a chance of picking any of the remaining non-chosen integers.

5 Claims, 8 Drawing Figures

SET OF DICES FOR LOTTERY

FIELD OF THE INVENTION

This invention relates to throwing dices.

BACKGROUND OF THE INVENTION

Lotteries are presently very popular especially those of the type in which a player selects a pre-determined number of integers in a given series of such integers. For instance in the lottery known as the 6–36, the lottery player has to pick six numbers between 1 and 36. Similarly in the lottery known as the 6–49, the player has to choose six numbers between 1 and 49. In still another type of lottery, the player has to choose three numbers between 0 and 10.

A number of devices are known to help the lottery player in the selection of a hopefully winning set of numbers. These known devices are often complicated to use and expensive to manufacture.

OBJECT OF THE INVENTION

The object of the present invention is to provide a set of dices for the choosing of numbers from a large range of numbers to be played in a lottery event.

Another object of the present invention is the provision of a set of dices for the purpose described, in which the number of dices is limited with respect to the large range of numbers available.

SUMMARY OF THE INVENTION

The set of dices for the invention is suited for a lottery of the type in which one must select a pre-determined of integers in a given series of such integers. The number of dices in the set is equal to the number of integers to be selected in the specific lottery type. At least some of the six faces of each dice bears at least two distinct integers forming two series of lottery integers. The dice integers are distributed on various dice faces such that each integer appears on two dices and such that all the integers on any given dice does not appear on any other single dice, but are distributed amongst the remaining dices of the set. The integers appearing on any one dice face are directed away from each other. The player picks up the integer on the topmost face of the thrown dice which faces him. After each dice throw, the player has a chance of picking any of the remaining non-picked integers.

DETAILED DESCRIPTION OF THE PREFERRED EMODIMENTS OF THE INVENTION

Figure 1:
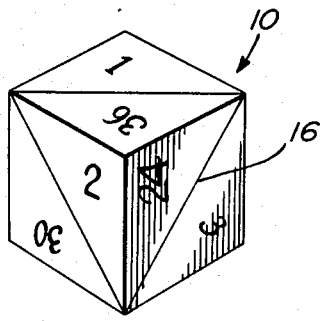
FIGS. 1 and 2 are perspective views of two different cubic dices used to play the lottery type known as the 6–36.
Figure 2:
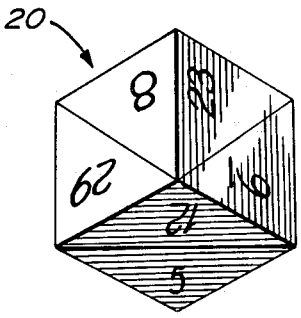
Figure 3:
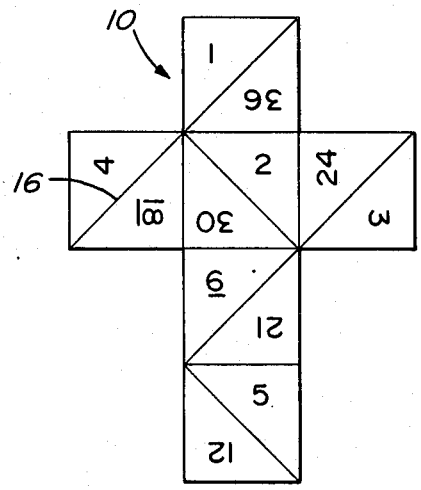
FIGS. 3 and 4 are developed plan views of the faces of the dices of FIGS. 1 and 2 respectively.
Figure 4:
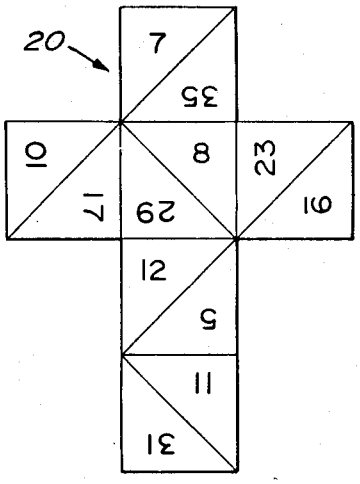
Figure 5:
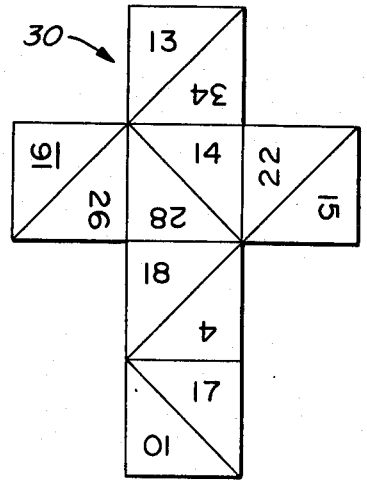
FIGS. 5 to 8 are developed plan views of the faces of the four other dices, of the set for playing the 6–36.
Figure 7:
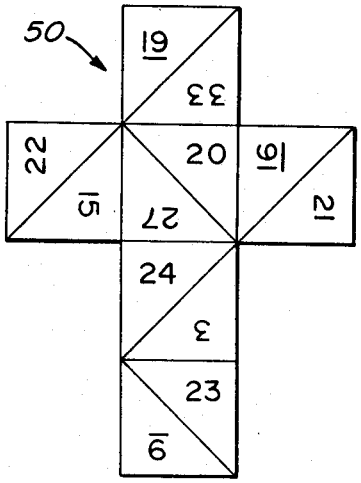
Figure 6:
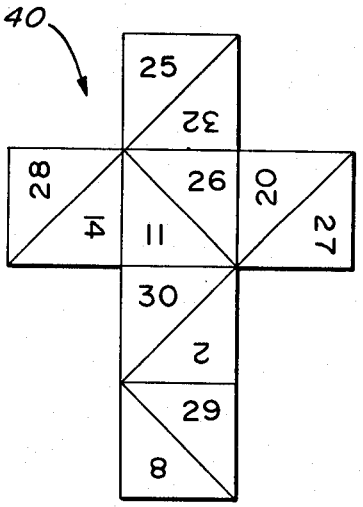
Figure 8:
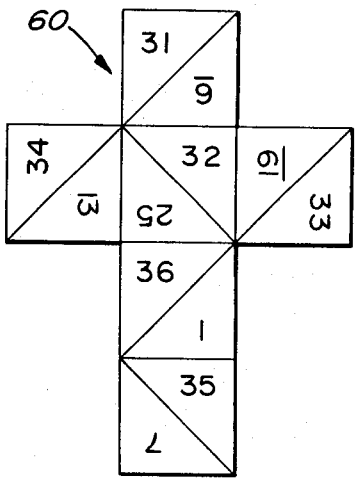

FIGS. 1 and 3 show a cubic dice 10 comprising six faces, each face being provided with two triangular sectors, as defined by diagonal line 16, which may be a groove. Each sector bears an integer and the two integers are in inverted position on the dice face. The second dice 20 of FIGS. 2 and 4, as well as third to sixth dices 30, 40, 50 and 60 of FIGS. 5 to 8 respectively, have similar features compared to dice 10. It will be seen that the integers inscribed on the various dice faces are as shown in Table I.

TABLE I

| dice | face | | | | | |
|---|---|---|---|---|---|---|
| No. | 1 | 2 | 3 | 4 | 5 | 6 |
| 1 | 1–36 | 2–30 | 3–24 | 4–18 | 5–12 | 6–21 |
| 2 | 7–35 | 8–29 | 9–23 | 10–17 | 11–31 | 12–5 |
| 3 | 13–34 | 14–28 | 15–22 | 16–26 | 17–10 | 18–4 |
| 4 | 19–33 | 20–27 | 21–16 | 22–15 | 23–9 | 24–3 |
| 5 | 25–32 | 26–11 | 27–20 | 28–14 | 29–8 | 30–2 |
| 6 | 31–6 | 32–25 | 33–19 | 34–13 | 35–7 | 36–1 |

Numbers 1 to 36 increase horizontally from left to right. These numbers are repeated vertically in decreasing order from left to right, except for the underlined numbers 6, 11, 16, 26, 31 and 21. Each number appears twice on the six dices but only once on each dice. This embodiment is used to bet on the lottery known as the 6–36: one chooses six integers between 1 and 36. The six dices are sequentially thrown and each time the player writes down the topmost number facing him. The integers are distributed on the various dice faces such that each integer will appear on two dices and such that all the integers on any dice do not appear on any other single dice but are distributed amongst the remaining dices of the set. Therefore, it follows that after each dice throw the player has a chance of picking any of the non-picked integers. The player has an equal chance of picking any of the integers from 1 to 36 and this for the six numbers composing the lottery 6–36.

A variation of this arrangement would be to have certain numbers appear on the dice faces less than two times and some other members more than two times providing a set of dices in which the oods would be increased for certain numbers and decreased for some other numbers to assist the player in choosing the integers of the lottery for which he might think that certain numbers are more likely to be winning numbers.

With the dice system of the invention, it is noted that a limited number of dices can be used to select a range of numbers which is six times more than the number of dices.

In accordance with the second embodiment, a set of six dices is designed to play the lottery of the type known as the 6–49 in which six numbers have to be picked up from a set of integers from 1 to 49. The dices of FIGS. 1 to 8 are used but with the addition of 13 integers from 37 to 49 twice repeated on the dice faces, in accordance with table II as follows:

TABLE II

| dice | face | | | | | |
|---|---|---|---|---|---|---|
| No. | 1 | 2 | 3 | 4 | 5 | 6 |
| 1 | 1–36 | 2–30–48 | 3–24–45 | 4–18–39 | 5–12–47 | 6–21 |
| 2 | 7–35–46 | 8–29–39 | 9–23–43 | 10–17–41 | 11–31 | 12–5–45 |
| 3 | 13–34–47 | 14–28–44 | 15–22 | 16–26 | 17–10–43 | 18–4–37 |

TABLE II-continued

| dice No. | face 1 | 2 | 3 | 4 | 5 | 6 |
|---|---|---|---|---|---|---|
| 4 | 19-33-48 | 20-27-42 | 21-16 | 22-15 | 23-9-41 | 24-3-38 |
| 5 | 25-32-40 | 26-11 | 27-20-44 | 28-14-42 | 29-8-49 | 30-2-39 |
| 6 | 31-6 | 32-25-38 | 32-19-46 | 34-13-40 | 35-7-37 | 36-1 |

The additional integers face in a direction away from the two other integers on each face so that when a dice is thrown, the player will again pick up the integer facing him. The additional integers are so distributed as to follow the above described rules for the first embodiment and such that the player has an equal chance of picking up any of the integers from 1 to 49 after having thrown the six dices.

In a third embodiment, there are three dices in the set to be used for playing a type of lottery game in which three numbers from 0 to 9 have to be selected. Four faces out of six of each of the three dices include two numbers in two different sectors whereas the remaining two faces hold only one centrally located number. The numbers are distributed as follows:

TABLE III

| dice no. | face 1 | 2 | 3 | 4 | 5 | 6 |
|---|---|---|---|---|---|---|
| 1 | 0 | 1 | 2-6 | 3-7 | 4-8 | 5-9 |
| 2 | 0-6 | 1-7 | 2 | 3 | 4-8 | 5-9 |
| 3 | 0-6 | 1-7 | 2-8 | 3-9 | 4 | 5 |

Each each every number from 0 to 9 appears three times in all three dices. However, since some faces hold a single number (numbers 0 to 5) while the majority hold two numbers, numbers 0 to 5 have a greater probability of occurrence, whereas 6 to 9 have the lowest probability of occurrence.

What we claim is:

1. A set of dices to be thrown on a surface for aiding a lottery player in the selection of winning integers in a lottery of the type in which one must select a pre-determined number of integers in a given series of such integers, the number of dices in the set being equal to the number of integers to be selected in the specific lottery type, at least some of the six faces of each dice bearing at least two distinct integers forming two series of lottery integers, the dice integers being distributed on the various dice faces such that each integer will appear on two dices and such that all the integers on any given dice will not appear on any other single dice but will be distributed amongst the remaining dices of the set.

2. A set of dices as defined in claim 1, wherein the type of lottery is the 6-36 and there are six dices bearing two series of integers from 1 to 36 on the dice faces.

3. The set of dices as defined in claim 2, wherein the integers on the dice faces are distributed as follow:

TABLE I

| dice No. | face 1 | 2 | 3 | 4 | 5 | 6 |
|---|---|---|---|---|---|---|
| 1 | 1-36 | 2-30 | 3-24 | 4-18 | 5-12 | 6-21 |
| 2 | 7-35 | 8-29 | 9-23 | 10-17 | 11-31 | 12-5 |
| 3 | 13-34 | 14-28 | 15-22 | 16-26 | 17-10 | 18-4 |
| 4 | 19-33 | 20-27 | 21-16 | 22-15 | 23-9 | 24-3 |
| 5 | 25-32 | 26-11 | 27-20 | 28-14 | 29-8 | 30-2 |
| 6 | 31-6 | 32-25 | 33-19 | 34-13 | 35-7 | 36-1 |

4. The set of dices as defined in claim 1, wherein the type of lottery is the 6-49 and there are six dices bearing two series of lottery integers from 1 to 49 on the dice faces, these series of integers being distributed on the dice faces in accordance with the following table:

TABLE II

| dice No. | face 1 | 2 | 3 | 4 | 5 | 6 |
|---|---|---|---|---|---|---|
| 1 | 1-36 | 2-30-48 | 3-24-45 | 4-18-39 | 5-12-47 | 6-21 |
| 2 | 7-35-46 | 8-29-39 | 9-23-43 | 10-17-41 | 11-31 | 12-5-45 |
| 3 | 13-34-47 | 14-28-44 | 15-22 | 16-26 | 17-10-43 | 18-4-37 |
| 4 | 19-33-48 | 20-27-42 | 21-16 | 22-15 | 23-9-41 | 24-3-38 |
| 5 | 25-32-40 | 26-11 | 27-20-44 | 28-14-42 | 29-8-49 | 30-2-39 |
| 6 | 31-6 | 32-25-38 | 32-19-46 | 34-13-40 | 35-7-37 | 36-1 |

5. The set of dices as defined in claim 1, wherein the lottery type is one in which three integers from 0 to 9 must be selected, there being three dices in the set and the integers appearing on the dice faces being arranged as follows:

TABLE III

| dice no. | face 1 | 2 | 3 | 4 | 5 | 6 |
|---|---|---|---|---|---|---|
| 1 | 0 | 1 | 2-6 | 3-7 | 4-8 | 5-9 |
| 2 | 0-6 | 1-7 | 2 | 3 | 4-8 | 5-9 |
| 3 | 0-6 | 1-7 | 2-8 | 3-9 | 4 | 5 |

* * * * *